US005141659A

United States Patent [19]

Kashiwaya et al.

[11] Patent Number: 5,141,659

[45] Date of Patent: Aug. 25, 1992

[54] LUBRICATING AGENT FOR USE IN WARM AND HOT FORGING

[75] Inventors: Satoshi Kashiwaya; Itaru Ishibashi, both of Kuwana; Tamotsu Nakamura, Hamamatsu, all of Japan

[73] Assignee: Sumico Lubricant Co., Ltd., Tokyo, Japan

[21] Appl. No.: 637,274

[22] Filed: Jan. 3, 1991

[30] Foreign Application Priority Data

Jan. 11, 1990 [JP] Japan ..... 2-3815

[51] Int. Cl.[5] ..... C10M 173/00; C10M 107/02

[52] U.S. Cl. ..... 252/49.3; 585/12

[58] Field of Search ..... 252/25, 28, 49.5, 49, 252/52 A, 9, 49.3; 585/12

[56] References Cited

U.S. PATENT DOCUMENTS

| | | | |
|---|---|---|---|
| 3,227,652 | 1/1966 | Ackerman | 252/49.5 |
| 3,729,415 | 4/1973 | Davis et al. | 252/25 |
| 3,985,661 | 10/1976 | Ikeda et al. | 252/12.4 |
| 4,111,820 | 9/1978 | Conti | 252/52 A |
| 4,239,632 | 12/1980 | Baile | 252/25 |
| 4,800,033 | 1/1989 | Stetter | 585/12 |
| 4,915,856 | 4/1990 | Jamison | 252/26 |

*Primary Examiner*—Jacqueline Howard

*Attorney, Agent, or Firm*—Watson, Cole, Grindle & Watson

[57] ABSTRACT

A lubricating composition possessing properties highly suitable for warm and hot forging has an ultrahigh molecular polyethylene powder possessing a molecular weight of not less than 1,000,000 dispersed and contained in a medium of water or oil; has an ultrahigh molecular polyethylene powder possessing a molecular weight of not less than 1,000,000 and an inorganic solid lubricant of a white or light color dispersed and contained in a medium of water or oil; or has an ultrahigh molecular polyethylene powder possessing a molecular weight of not less than 1,000,000 and a polyethylene oxide powder possessing a melting point in the range of 80° to 120° C. dispersed and contained in a medium of water.

17 Claims, No Drawings

LUBRICATING AGENT FOR USE IN WARM AND HOT FORGING

BACKGROUND OF THE INVENTION

1. Field of the Invention

This invention relates to a white or light-colored lubricating composition for use in warm and hot forging.

2. Description of the Prior Art

In warm and hot forging, which comprises heating and forging a metallic or alloy material blank, the die is kept heated at a temperature in the range of 100° to 400° C. during the forging operation. This forging requires the use of a heat resistant lubricant. A black lubricant, e.g., having an inorganic solid lubricant graphite or molybdenum disulfide, dispersed in either water, a mineral oil, or a synthetic oil. Such a solid lubricant exhibits outstanding lubricity at elevated temperatures.

However, since the black lubricant entails problems from the standpoint of working environments such as smearing of the site of use or betraying electroconductivity, there has been expressed a desire to utilize a harmless white lubricant. The conventional white forging quality lubricant, however, has the problem of a high coefficient of friction at the warm and hot forging temperatures as compared with the lubricant such as of graphite.

The coefficients of friction which the conventional black lubricants exhibit at prevalent warm and hot forging temperatures are not sufficiently small. The lubricants have the possibility of being seized by the die and do not always permit fully satisfactory release of a forged product from the die.

SUMMARY OF THE INVENTION

This invention, conceived to eliminate the problems of the prior art described above, aims to provide a white or light-colored warm and hot forging quality lubricating composition which does not harm human beings, which exhibits a sufficiently low coefficient of friction at prevalent warm and hot forging temperatures, and which excels in releasability from the die and resistance to seizure by the die.

According to a first aspect of this invention, the lubricating composition comprises an ultrahigh molecular weight polyethylene powder of a molecular weight of not less than 1,000,000 dispersed and contained in a medium of water or oil. The second aspect of this invention resides in having an ultrahigh molecular weight polyethylene powder of a molecular weight of not less than 1,000,000 and a white or light-colored inorganic solid lubricant powder dispersed and contained in a medium of water or oil. The third aspect of this invention resides in having an ultrahigh molecular weight polyethylene powder of a molecular weight of not less than 1,000,000 and a polyethylene oxide powder possessing a melting point in the range of 80° to 120° C. dispersed and contained in a medium of water.

DESCRIPTION OF THE PREFERRED EMBODIMENT

This invention is characterized by the fact that the ultrahigh molecular weight polyethylene powder is used as a lubricant as described above. This substance is known to be white and harmless to human beings and capable of exhibiting an outstanding self-lubricating property in the neighborhood of room temperature.

The ultrahigh molecular weight polyethylene powder to be used for this invention is desired to have a particle diameter of not larger than about 30 μm. When it has a larger particle diameter, it is desired to be given a suitable treatment for size reduction prior to use.

The media which are effectively usable in this invention include water and oils. The oil to be used may be suitably selected from among mineral oils, vegetable oils, synthetic oils, etc., depending on the conditions to be employed. Since this invention is directed to providing a white or light-colored lubricant, the oil to be used is desired to be transparent or to be white or light in color.

By causing the ultrahigh molecular weight polyethylene powder of a molecular weight of not less than 1,000,000 to be dispersed and contained in the medium mentioned above, the lubricating composition can be obtained. This composition, when necessary, may incorporate therein such known additives as surfactant, antiseptics, a thickener, and inorganic solid lubricant.

These additives are capable of not only synergistically enhancing the lubricating effect but also improving the stability of the composition and stabilizing the ability to lubricate.

The surfactant may be any of anionic, nonionic, and cationic surfactants which are compatible with the medium to be used for the dispersion.

The antiseptics and thickener may be those which are generally used in lubricating compositions.

Generally, the amounts of the surfactant, antiseptics, and thickener to be added are each in the range of 0.1 to 10% by weight as popularly observed in the formulation of lubricants of this class.

In the inorganic solid lubricant powders, the white inorganic solid lubricant powders which are effectively usable herein include boron nitride (BN), cerium fluoride ($CeF_3$), zinc sulfide (ZnS), antimony trioxide ($Sb_2O_3$), zinc oxide (ZnO), calcium fluoride ($CaF_2$), and white mica and the light-colored inorganic solid lubricant powders which are effectively usable herein include green mica and light brown mica, for example. Further, white to light-colored clayish minerals such as bentonite and kaoline can be used.

When water is used as the medium, the lubricant powder may be used in combination with a polyethylene oxide powder possessing a melting point in the range of 80° to 120° C.

The composition of this invention is easily obtained by mixing the ultrahigh molecular weight polyethylene powder with the medium and the additives mentioned above. The lubricating composition is put to use as applied to the die by spraying, brushing, soaking, etc.

The ultrahigh molecular weight polyethylene powder to be used in this invention is defined as one possessing a molecular weight of not less than 1,000,000. The reason for this molecular weight is as follows. If the molecular weight is less than 1,000,000, the polyethylene powder is completely volatilized at the prevalent warm and hot forging temperatures and is prevented from manifesting the expected lubricity. The polyethylene powder possessing a molecular weight exceeding 1,000,000 is not wholly volatilized even when it is carbonized at temperatures closely approximating 400° C. The carbide thus produced retains lubricity and, even when it is fused or converted into a carbide on the surface of lubrication at elevated temperatures, exhibits an outstanding following property, manifests a low coefficient of friction and, at the same time, prevents direct contact from occurring between the die and the blank being forged and precludes the phenomenon of seizure. Once the die is cooled, the polyethylene powder forms a relatively hard film on the surface of the die and this film brings about a satisfactory mold-release property.

The ultrahigh molecular polyethylene powder can be used in an amount in the range of 0.1 to 40% by weight. If this amount is less than 0.1% by weight, there arises the possibility that the amount of the polyethylene powder which survives the carbonization at the elevated temperatures is too small to preclude, seizure. If the amount exceeds 40% by weight, the excess does not proportionately add to the lubricating and causes clogging of recesses in the die. Desirably, the amount of the polyethylene powder to be added is in the range of 5 to 20% by weight.

The white or light-colored inorganic solid lubricant can be incorporated in an amount in the range of 0.1 to 40% by weight. The smallest amount in which the inorganic solid lubricant manifests its effect in the combined use with the ultrahigh molecular polyethylene powder is about 0.1% by weight. If the amount exceeds 40% by weight, the excess does not proportionately add to the lubricating ability and causes clogging of recesses in the die. Desirably, the amount of the inorganic solid lubricant to be incorporated is in the range of 5 to 20% by weight.

This inorganic solid lubricant, owing to the presence of the ultrahigh molecular weight polyethylene powder, manifests the lubricating effect never attained when this inorganic solid lubricant is incorporated alone in the medium. Though the reason for this behavior is not clear, the behavior may be logically explained by a postulate that even when the forging is carried out at such a high temperature as to induce volatilization of the ultrahigh molecular weight polyethylene, the ultrahigh molecular weight polyethylene or the carbide thereof retained in the recesses in the surface of the inorganic solid lubricant lends itself to lowering the coefficient of friction of the surface of the inorganic solid lubricant.

When the lubricating composition incorporating therein the ultrahigh molecular weight polyethylene powder is supplied by spraying to the die and the medium is water, since the ultrahigh molecular weight polyethylene powder exhibits poor adhesiveness to the die, the composition deposited in an insufficient amount has the possibility of heightening the coefficient of friction so much as to induce the seizure of the composition by the die. The addition of polyethylene oxide may be relied on for effective preclusion of this disadvantage. The polyethylene oxide softens and melts at low temperatures, facilitates the adhesion of the ultrahigh molecular weight polyethylene powder to the die, and functions to lower the coefficient of friction.

If the polyethylene oxide has a melting point of less than 80° C., it undergoes decomposition early and fails to enhance the adhesiveness of the ultrahigh molecular weight polyethylene powder to the die at elevated temperatures. Conversely, if the polyethylene oxide powder has a melting point exceeding 120° C., it shows poor dispersibility in water. Thus, the polyethylene oxide powder is defined as the one possessing a melting point in the range of 80° to 120° C.

The amount of polyethylene oxide powder incorporated in the lubricating composition is desired to be in the range of 0.5 to 20% by weight. If this amount is less than 0.5% by weight, an insufficiently high adhesiveness is imparted. If this amount exceeds 20% by weight, the excess does not proportionately add to the adhesiveness. Desirably, the amount of incorporation is in the range of 0.8 to 2% by weight.

Now, the invention will be described more specifically below with reference to working examples, which are intended to be merely illustrative of and not in any way limitative of the present invention.

EXAMPLE 1

A total of 23 lubricating compositions were prepared by formulating varying components shown in Table 1 in varying proportions shown in Table 2.

They were tested by the method of ring compression which is widely used in estimating a coefficient of friction during deformation in consequence of an increase in surface area as in the processing of forging.

As forging quality test pieces, the ring test pieces of C-3771 forging quality brass (Test Runs No. 1 to 15), aluminum A-6061 (Test Runs No. 16 to 19), and low carbon steel SWCH10K (Test Runs No. 20 to 23), according to JIS H3250, measuring 21.0 mm in outside diameter, 10.5 mm in inside diameter, and 7.0 mm in thickness, and having two disklike surfaces thereof finished to center line average height in the range of 0.3 to 0.6 μm were used.

Compressing tools were made of an tool steel alloy SKD61, with the parallel compressing surfaces finished to a center line average height of 0.02 μm. A given test piece was inserted between two compressing tools in such a manner that the two disklike surfaces thereof contact the parallel compressing surfaces of the compressing tools. Then the inserted test piece was compressed at a compressing speed of 0.1 mm/sec. to 50% of reduction height.

In Test Runs No. 1 to 10 and No. 16 to 23, about 0.1 g of the lubricating composition was applied by brushing at room temperature to the compressing surfaces of the compressing tools and heated to 350° C. The test pieces of brass were heated to 700° C., those of aluminum to 500° C., and those of low carbon steel to 800° C. and they were subjected to the compression test when the compressing tools were heated to 300° C. In Test Runs No. 11 to 15, the lubricating composition was applied to the compressing tools heated in advance to 350° C. by spraying with a spray gun possessing a nozzle diameter of 0.8 mm and using a spray pressure of 174 kpa (1.5 kgf/cm$^2$) and the test pieces were subjected to the same ring compression test in the same manner as in Test Runs No. 1 to 10 and No. 16 to 23. The results are shown in Table 2. In Table 2, the mold release property was rated as follows.

Satisfactory: The forged product was in state separated from the die and could be released from the die without requiring any special external work.

Acceptable: The forged product, though not separated from the die, could be released from the die by ordinary effort.

Rejectable: The forged product was seized by the die and could not be released by ordinary effort.

TABLE 1

| Symbol | Name of component |
|---|---|
| A | High molecular weight polyethylene having a |

TABLE 1-continued

| Symbol | Name of component |
|---|---|
| | molecular weight of 200,000 and an average particle diameter of 20 μm |
| B | Ultrahigh molecular weight polyethylene having a molecular weight of 2,000,000 and an average particle diameter of 20 to 30 μm |
| C | Ultrahigh molecular polyethylene having a molecular weight of 5,800,000 and an average particle diameter of 20 to 30 μm |
| D | Polypropylene having an average particle diameter of 20 to 30 μm |
| E | Graphite having an average particle diameter of 2 to 40 μm |
| F | Melamine cyanurate having an average particle diameter of 0.5 to 5 μm |
| G | ZnS having an average particle diameter of 0.1 to 5 μm |
| H | Bn having an average particle diameter of 1 to 10 μm |
| I | Silicone resin having an average particle diameter of 1 to 15 μm |
| J | Polyethylene oxide having an average particle diameter of 20 to 30 μm |
| K | Water |
| L | Liquid paraffin exhibiting a viscosity of 16 cst. at 40° C. |
| M | Nonionic surfactant |
| N | Antiseptics and thickener |

Note:
M stands for a surfactant formed of a water-soluble vegetable oil derivative and N for an organic nitrogen sulfur type antiseptic agent. A cellulose type resin thickener was used Runs No. 2 and 13 and between the results of Test Runs No. 6 and 15 that the lubricating composition applied by spraying produced larger coefficients of friction than those applied by brushing. By comparison between the results of Test Runs No. 11 and 13, however, it is seen that addition of polyethylene oxide brought about a generous decrease in the coefficient of friction. It is noted from the results of Test Run No. 14 that the addition of 0.05% by weight was too small for the ultrahigh molecular weight polyethylene of a molecular weight of 1,000,000 to manifest the expected effect.

EXAMPLE 2

Test pieces were made of JIS G4303, SUS630 Stainless steel and compressing tools were made of tool steel alloy SKD61. The test pieces were compressed at a compressing speed of about 152 mm/sec. to a reduction height of about 55%, with the temperature of the compressing tools kept at 200° C. during the process of compression. The varying lubricating compositions indicated below, some of which used water as a medium and were diluted with water to 5 times the original volume, were applied to the die by spraying for two seconds from a distance of 20 cm. Then, a given test piece heated in advance to 1,100° C. was compressed. The other conditions for test were identical with those used in Example 1.

The lubricating compositions and the coefficients of friction determined by the test were shown below. Lubricating compositions:

| | % by weight |
|---|---|
| Test Run No. 24 (example of the invention) | |
| Ultrahigh molecular weight polyethylene possessing average molecular weight of 2,000,000 and average particle diameter of 20 to 30 μm | 10 |
| ZnS possessing average particle diameter of 0.1 to 5 μm | 10 |
| Surfactant | 2 |
| Antiseptics and thickener | 8 |
| Water | 70 |
| Coefficient of friction | 0.17 |

TABLE 2

| Example No. | Composition (Component sign/% by weight) Solid lubricant | | Additive | | Medium | Coefficient of friction | Seizure | Mold releasability | Remarks |
|---|---|---|---|---|---|---|---|---|---|
| 1 | B/11 | — | — | — | L/89 | 0.008 | None | Satisfactory | Example of invention |
| 2 | B/11 | — | — | — | K/89 | 0.010 | " | " | " |
| 3 | C/11 | — | — | — | K/89 | 0.005 | " | " | " |
| 4 | A/11 | — | — | — | K/89 | 0.230 | None | Satisfactory | Comparison |
| 5 | D/11 | — | — | — | K/89 | 0.200 | Medium | Acceptable | " |
| 6 | E/11 | — | — | — | L/89 | 0.075 | Heavy | Rejectable | Comparison (black) |
| 7 | F/11 | — | — | — | L/89 | 0.170 | Slight | Acceptable | " |
| 8 | G/11 | — | — | — | L/89 | 0.210 | Slight | " | Comparison (black) |
| 9 | H/11 | — | — | — | L/89 | 0.130 | None | Satisfactory | " |
| 10 | I/11 | — | — | — | L/89 | 0.210 | Slight | Acceptable | " |
| 11 | B/11 | J/1 | M/2 | N/1 | K/85 | 0.020 | None | Satisfactory | Example of invention |
| 12 | B/6 | J/1 | M/2 | N/1 | K/90 | 0.025 | " | " | " |
| 13 | B/11 | — | M/2 | N/1 | K/86 | 0.120 | " | " | " |
| 14 | B/0.05 | J/1 | M/2 | N/1 | K/95.95 | 0.150 | Slight | Acceptable | Comparison |
| 15 | E/11 | J/1 | M/2 | N/1 | K/85 | 0.100 | Heavy | Rejectable | Comparison (black) |
| 16 | B/11 | — | — | — | L/89 | 0.015 | None | Satisfactory | Example of invention |
| 17 | B/11 | — | — | — | K/85 | 0.020 | " | " | " |
| 18 | E/11 | — | — | — | L/89 | 0.110 | Heavy | Acceptable | Comparison (black) |
| 19 | E/11 | — | — | — | K/89 | 0.120 | " | Rejectable | " |
| 20 | B/11 | — | — | — | L/89 | 0.008 | None | Satisfactory | Example of invention |
| 21 | B/11 | — | — | — | K/89 | 0.010 | " | " | " |
| 22 | E/11 | — | — | — | L/89 | 0.060 | Slight | Acceptable | Comparison (black) |
| 23 | E/11 | — | — | — | K/89 | 0.060 | " | " | " |

In the test runs involving the application of lubricating composition by brushing, it is noted from the results of Test Runs No. 4 to 10, 18, 19, 22, and 23 that the compositions having dispersed in media lubricant powders other than the ultrahigh molecular weight polyethylene of a molecular weight exceeding 1,000,000 invariably showed coefficients of friction one place higher and from the results of Test Runs No. 1 to 3, 16, 17, 20, and 21 that the lubricating compositions incorporating ultrahigh molecular weight polyethylene powder of a molecular weight exceeding 1,000,000 exhibited highly satisfactory properties of lubrication without reference to choice between water and oil as a medium.

Test Runs No. 11 to 15 were those involving the application of the lubricating composition by spraying. It is seen by comparison between the results of Test -continued

| | % by weight |
|---|---|
| Test Run No. 25 (example of the invention) | |
| Ultrahigh molecular weight polyethylene possessing average molecular weight of 2,000,000 and average particle diameter of 20 to 30 μm | 10 |
| Bentonite vested with oleophilicity possessing particle diameters not exceeding 0.5 μm (marketed under trademark designation of "Esben") | 10 |
| Liquid paraffin possessing viscosity of 16 cst. at 40° C. | 80 |
| Coefficient of friction | 0.12 |
| Test Run No. 26 (comparative experiment) | |
| Ultrahigh molecular weight polyethylene possessing average molecular weight of 2,000,000 and average particle diameter of 20 to 30 μm | 10 |
| Surfactant | 2 |
| Antiseptics and thickener | 8 |
| Water | 80 |
| Coefficient of friction | 0.20 |
| Test Run No. 27 (comparative experiment) | |
| Bentonite vested with oleophilicity (marketed under trademark designation of "Esben") | 20 |
| Liquid paraffin possessing viscosity of 16 cst. at 40° C. | 80 |
| Coefficient of friction | 0.25 |
| Test Run No. 28 (comparative experiment) | |
| Commercially available aqueous type lubricant containing 25% by weight of graphite | |
| Coefficient of friction | 0.19 |
| Test Run No. 29 (comparative experiment) | |
| ZnS possessing average particle diameter of 0.1 to 5 μm | 10 |
| Surfactant | 2 |
| Antiseptics and thickener | 8 |
| Water | 80 |
| Coefficient of friction | 0.23 |

As demonstrated above, the combined use of an ultrahigh molecular weight polyethylene powder possessing a molecular weight of not less than 1,000,000 and an inorganic solid lubricant powder allows a decrease in the coefficient of friction at elevated temperatures as compared with the conventional lubricating composition having an inorganic solid lubricant alone dispersed in a medium.

In accordance with this invention, there is provided a white to light-colored lubricating composition which is excellent in resistance to seizure by the die at elevated temperatures and in the mold-releasing ability and, unlike the conventional black lubricating composition, incapable of impairing the working environments.

What is claimed is:

1. A lubricating composition for use in warm and hot forging, comprising an ultrahigh molecular weight polyethylene powder of a molecular weight of not less than 1,000,000 dispersed and contained in a water medium.

2. A composition according to claim 1, wherein said polyethylene powder is composed of particles having diameters not exceeding 30 um.

3. A composition according to claim 1, which further comprises one member selected from among surfactants, antiseptics, thickeners, and inorganic solid lubricants.

4. A composition according to claim 3, wherein the amount of said surfactants, antiseptics, or thickeners to be added is in the range of 0.1 to 10% by weight.

5. A composition according to claim 1, containing between 0.1 and 40% by weight of said ultrahigh molecular weight polyethylene powder.

6. A composition according to claim 5, wherein said ultrahigh molecular weight polyethylene powder has a molecular weight of at least 2,000,000.

7. A lubricating composition for use in warm and hot forging, comprising an ultrahigh molecular weight polyethylene powder of a molecular weight of not less than 1,000,000 and an inorganic solid lubricant of a white or light color dispersed and contained in a water medium.

8. A composition according to claim 7, wherein said polyethylene powder is composed of particles having diameters not exceeding 30 mm.

9. A composition according to claim 7, which further comprises one member selected form among surfactants, antiseptics, thickeners, and inorganic solid lubricants.

10. A composition according to claim 7, wherein the amount of said surfactants, antiseptics, or thickeners added is in the range of 0.1 to 10% by weight.

11. A lubricating composition for use in warm and hot forging, comprising an ultrahigh molecular weight polyethylene powder of a molecular weight of not less than 1,000,000 and a polyethylene oxide powder possessing a melting point in the range of 80° to 120° C. dispersed and contained in a water medium.

12. A composition according to claim 11, wherein said polyethylene powder is composed of particles having diameters not exceeding 30 um.

13. A composition according to claim 11, which further comprises one member selected from among surfactants, antiseptics, viscosity enhances, and inorganic solid lubricants.

14. A composition according to claim 13, wherein the amount of said surfactants, added is in the range of oil to 10% by weight antiseptics, or viscosity enhancers.

15. A composition according to claim 7, wherein said inorganic solid lubrication is selected from the group consisting of boron nitride, cerium fluoride, zinc sulfide, antimony trioxide, zinc oxide, calcium fluoride, white mica, green mica, light brown mica, bentonite and kaoline.

16. A composition according to claim 7, containing between 0.1 and 40% by weight of said ultrahigh molecular weight polyethylene powder.

17. A composition according to claim 16, wherein said ultrahigh molecular weight polyethylene powder has a molecular weight of at least 2,000,000.

* * * * *